US007051553B2

(12) United States Patent
Mak et al.

(10) Patent No.: US 7,051,553 B2
(45) Date of Patent: May 30, 2006

(54) TWIN REFLUX PROCESS AND CONFIGURATIONS FOR IMPROVED NATURAL GAS LIQUIDS RECOVERY

(75) Inventors: John Mak, Santa Ana, CA (US); Curt Graham, Mission Viejo, CA (US); Chengwen Wayne Chung, Irvine, CA (US)

(73) Assignee: Floor Technologies Corporation, Aliso Viejo, CA (US)

( * ) Notice: Subject to any disclaimer, the term of this patent is extended or adjusted under 35 U.S.C. 154(b) by 0 days.

(21) Appl. No.: 10/469,456

(22) PCT Filed: May 20, 2002

(86) PCT No.: PCT/US02/16311

§ 371 (c)(1),
(2), (4) Date: Aug. 9, 2004

(87) PCT Pub. No.: WO03/100334

PCT Pub. Date: Dec. 4, 2003

(65) Prior Publication Data

US 2004/0261452 A1 Dec. 30, 2004

(51) Int. Cl.
*F25J 3/00* (2006.01)

(52) U.S. Cl. ..... 62/636; 62/625; 62/630

(58) Field of Classification Search ..... 62/636, 62/620, 625, 630
See application file for complete search history.

(56) References Cited

U.S. PATENT DOCUMENTS

| | | | | |
|---|---|---|---|---|
| 3,421,984 | A * | 1/1969 | Jensen et al. | 203/41 |
| 4,509,967 | A * | 4/1985 | Sweet | 62/625 |
| 4,657,571 | A * | 4/1987 | Gazzi | 62/621 |
| 5,220,797 | A * | 6/1993 | Krishnamurthy et al. | 62/620 |
| 5,685,170 | A * | 11/1997 | Sorensen | 62/625 |
| 6,368,385 | B1 * | 4/2002 | Paradowski | 95/181 |

* cited by examiner

*Primary Examiner*—William C. Doerrler
(74) *Attorney, Agent, or Firm*—Rutan&TuckerLLP

(57) ABSTRACT

A two-column NGL recovery plant includes an absorber (110) and a distillation column (140) in which the absorber (110) receives two cooled reflux streams, wherein one reflux stream (107) comprises a vapor portion of the NGL and wherein the other reflux stream (146) comprises a lean reflux provided by the overhead (144) of the distillation column (140). Contemplat configurations are especially advantageous in a upgrade of an existing NGL plant and typically exhibit $C_3$ recovery of at least 99% and C2 recovery of at least 90%.

22 Claims, 1 Drawing Sheet

TWIN REFLUX PROCESS AND CONFIGURATIONS FOR IMPROVED NATURAL GAS LIQUIDS RECOVERY

FIELD OF THE INVENTION

The field of the invention is natural gas liquids (NGL) recovery.

BACKGROUND OF THE INVENTION

Many natural and man-made gases comprise a variety of different hydrocarbons, and numerous gas separation processes and configurations are known in the art to produce commercially relevant fractions from such gases. In a typical gas separation process, a feed gas stream under pressure is cooled by heat exchanger and as the gas cools, liquids condense from the cooled gas. The liquids are then expanded and fractionated in a distillation column (e.g., de-deethanizer or demethanizer) to separate residual components such as methane, nitrogen and other volatile gases as overhead vapor from the desired $C_2$, $C_3$ and heavier components.

For example, Rambo et al. describe in U.S. Pat. No. 5,890,378 a system in which the absorber is refluxed, in which the deethanizer condenser provides the reflux for both the absorber and the deethanizer while the cooling requirements are met using a turbo expander, and in which the absorber and the deethanizer operate at substantially the same pressure. Although Rambo's configuration advantageously reduces capital cost for equipment associated with providing reflux for the absorption section and the de-deethanizer, propane recovery significantly decreases as the operating pressure in the absorber rises, especially at a pressure above 500 psig, where separation of ethane from propane in the de-deethanizer becomes increasingly difficult. Consequently, Rambo's system is generally limited by the upper operating limit of the de-deethanizer pressure. Increasing of the absorber pressure while maintaining desirable propane recovery becomes difficult, if not impossible in Rambo's process configuration. Moreover, operating the absorber and deethanizer at a pressure at or below 500 psig typically necessitates higher residue gas recompression, thereby incurring relatively high operating cost.

To circumvent at least some of the problems associated with relatively high cost associated with residue gas recompression, Sorensen describes in U.S. Pat. No. 5,953,935 a plant configuration in which the absorber reflux is produced by compressing, cooling, and Joule-Thomson expansion of a slipstream of feed gas. Although Sorensen's configuration generally provides an improved propane recovery with substantially no increase in plant residue compression horsepower, propane recovery significantly decreases as the operating pressure in the absorber rises, especially at a pressure above about 500 psig. Furthermore, ethane recovery using such known systems designed for propane recovery is normally limited to about 20% recovery.

In order to improve ethane recovery with a low $CO_2$ content in the ethane product, Campbell describes in U.S. Pat. No. 6,182,469 a tower reboiling scheme in which one or more tower liquid distillation streams from a point higher in the absorber are employed for stripping of undesirable components (e.g., carbon dioxide in a demethanizer). Campbell's scheme typically requires over-stripping of the ethane product, and $CO_2$ removal is generally limited to about 6%. Moreover, additional $CO_2$ removal using Campbell's process will significantly reduce ethane recovery, and increase power consumption. Furthermore, and especially where the ethane product is used for chemical production, the product in Campbell's configuration typically requires further treatment to remove $CO_2$ to or below a level of 500 ppmv, which often requires substantial capital and operating expenditure.

In yet other configurations, a turbo-expander is employed to provide the cooling of the feed gas in order to achieve a high propane or ethane recovery. Exemplary configurations are described, for example, in U.S. Pat. No. 4,278,457, and U.S. Pat. No. 4,854,955, to Campbell et al., in U.S. Pat. No. 5,953,935 to McDermott et al., in U.S. Pat. No. 6,244,070 to Elliott et al., or in U.S. Pat. No. 5,890,377 to Foglietta. While such configurations may provide at least some advantages over other processes, they typically require changes in existing expanders when the plant is upgraded to higher throughputs. Moreover, in such configurations the liquids separated are fed to the demethanizer operating at cryogenic temperature.

Thus, although various configurations and methods are known to recover various fractions from natural gas liquids, all or almost all of them suffer from one or more disadvantages. Therefore, there is still a need to provide methods and configurations for improved natural gas liquids recovery.

SUMMARY OF THE INVENTION

The present invention is directed towards methods and configurations of a plant in which a twin reflux to an absorber is provided, wherein one reflux stream is provided by a vapor portion of a feed gas, and wherein the other reflux stream is provided by the overhead product of a distillation column.

In one aspect of the inventive subject matter, the absorber further receives a liquid portion of the natural gas feed and a second vapor portion of the natural gas feed wherein the second portion is reduced in pressure via a turbo expander. Preferred absorbers further produce a bottom product that cools at least one of the first and second reflux streams, and at least a portion of the bottom product may be fed into the distillation column. Contemplated absorber overhead products may be employed to cool at least one of the first and second reflux streams, and may further cool at least one of the natural gas feed and a vapor portion of the natural gas feed. Preferred devices other than the turbo expander include a Joule-Thomson valve, and preferred distillation columns comprise a demethanizer or deethanizer. Where $C_2$ recovery is particularly preferred, it is contemplated that the first lean reflux stream may be fed into the absorber as a liquid feed, wherein the distillation column comprises a demethanizer. Preferred configurations are especially useful in a retrofit of an existing NGL plant to improve throughput while increasing the $C_2$ and $C_3$ recovery.

Consequently, in a further aspect of the inventive subject matter, a method of increasing throughput in a natural gas recovery plant having an absorber and a distillation column includes one step in which a first reflux stream is provided to the absorber, wherein the first reflux stream comprises an overhead product from the distillation column. In another step, a bypass is provided upstream of a turbo expander, wherein the bypass receives a vapor portion of a cooled natural gas liquid and provides the vapor portion to the absorber, and in yet another step, the pressure of the vapor portion is reduced before the vapor portion enters the absorber as a second reflux stream. In a still further step, a heat exchanger is provided that cools at least one of the first and second reflux streams using at least one of an absorber bottom product and an absorber overhead product.

Therefore, a method of operating a plant may include one step in which an absorber and a distillation column are provided. In a further step, a cooled lean overhead product from the distillation column is fed to the absorber as a first reflux stream, and in another step, the pressure of a cooled vapor portion of a natural gas feed is reduced via a device other than a turbo expander, wherein the cooled vapor portion that is reduced in pressure is fed to the absorber as a second reflux stream.

DETAILED DESCRIPTION

Figure 1:
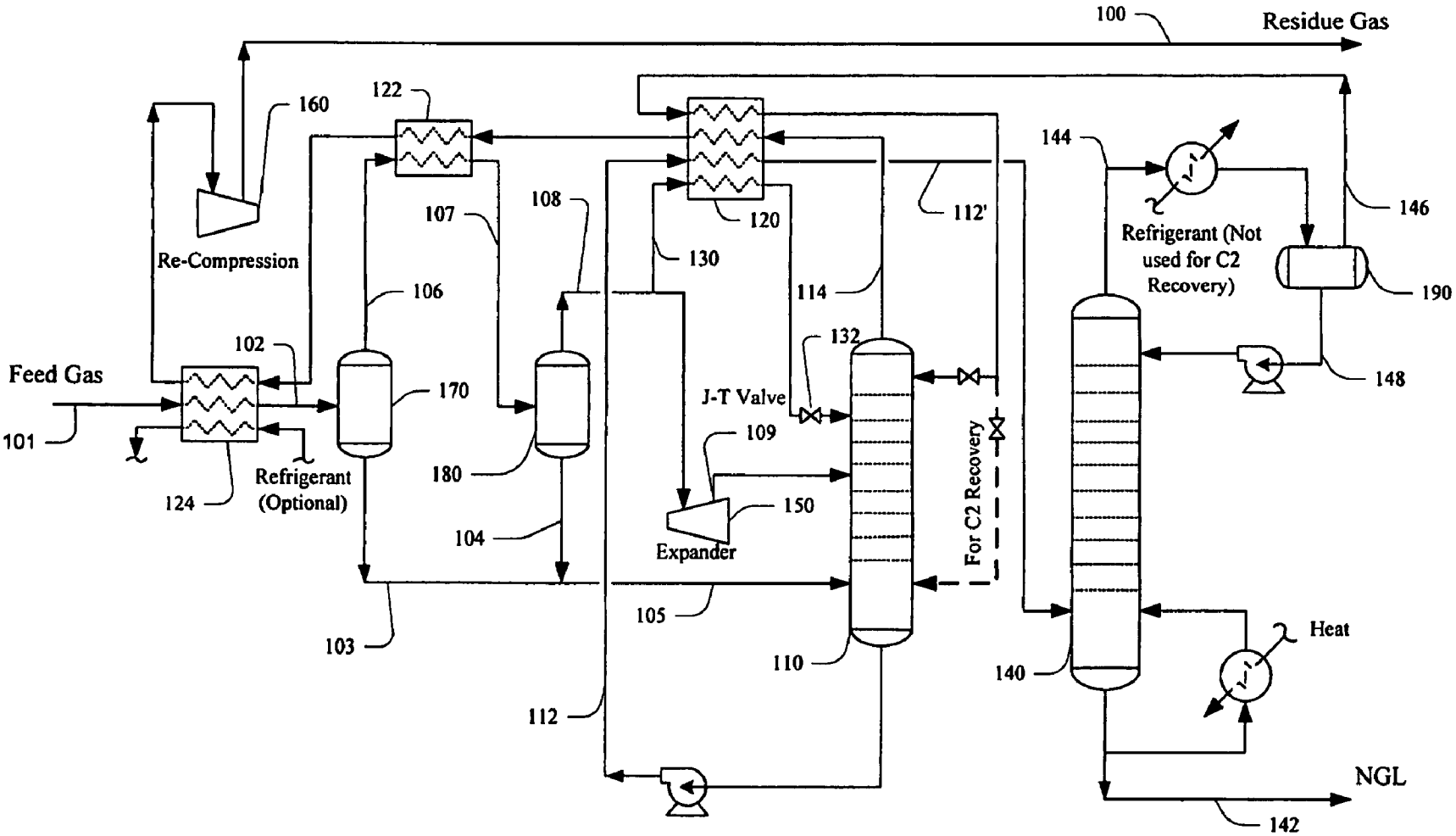
FIG. 1 is a schematic diagram of an exemplary plant configuration according to the inventive subject matter.

The inventors have discovered that high NGL recovery (e.g., at least 99% $C_3$ and at least 90% $C_2$) may be achieved in new and upgrade configurations in which an absorber receives two reflux streams. Furthermore, contemplated configurations will advantageously allow change in component recovery by changing process temperature and changing the feed point of one of the reflux streams into the absorber.

More specifically preferred plant configurations may include an absorber that receives a first reflux stream and a second reflux stream, the first reflux stream comprising a cooled lean overhead product from a distillation column, and the second reflux stream comprising a cooled vapor portion of a natural gas feed that is reduced in pressure via a device other than a turbo expander.

In a particularly preferred configuration as depicted in FIG. 1, a plant 100 comprises an absorber 110 that is fluidly coupled to a distillation column 140. A natural gas feed 101, with a typical composition by mole percent of 85% C1, 6% C2, 3% C3, 3% C4+ and 3% CO2 at 90° F. and 1200 psig, is cooled in a heat exchanger 124 to cooled natural gas feed 102 at −25° F. The condensed liquid portion of the cooled natural gas feed is separated in the separator 170 to form cooled liquid stream 103, while the cooled vapor portion 106 is further cooled via heat exchanger 122 to typically −35° F. to form further cooled vapor portion 107. The liquid from the further cooled vapor portion 107 are separated from the vapors in separator 180, which produces further cooled vapor stream 108 and further cooled liquid stream 104. The cooled liquid stream 103 and the further cooled liquid stream 104 are combined to form combined cooled liquid stream 105 at typically −75° F. and 410 psig, which is subsequently introduced as feed to the lower section of absorber 110.

In especially preferred configurations ranging from propane recovery to ethane recovery, the typical temperature ranges are illustrated as follows. The further cooled vapor stream 108 is split into a first portion that is expanded in a turbo-expander 150 to form expanded stream 109, typically at −100° F. to −115° F., which is introduced into the absorber 110, and a second portion stream 130 is still further cooled in heat exchanger 120 to typically −90° F. to −135° F., and reduced in pressure via a Joule-Thomson valve 132 before entering the absorber 110 as a reflux stream, typically at −125° F. to −140° F.

Absorber 110 forms an overhead product 114, typically at −100° F. to −135°, which is employed as a refrigerant in heat exchangers 120, 122, and 124 before a residue gas recompressor 160 recompresses the residue gas. Thus, it should be recognized that the overhead product cools the first and second absorber reflux, 146 and 130, respectively, and may further be employed as refrigerant to cool at least one of the vapor portions of the natural gas feed from the first and second separators. The absorber 110 further produces bottoms product 112, typically at −100° F. to −115° F., which also acts as a refrigerant in heat exchanger 120 to further cool the first and second reflux streams 146 and 130. The heated bottoms product 112, typically at −65° F. to −85° F., is then introduced into the distillation column 140, which separates the desired bottom product 142 (e.g., propane, or ethane/propane) from lean residue gas 144. The lean residue gas 144 may then be cooled with a cooler before entering separator 190 that produces a distillation column reflux 148 and the lean absorber reflux stream 146, typically at −85° F. to −115° F.

It should be particularly appreciated that contemplated configurations may be employed for high propane recovery as well as for high ethane recovery. For example, where high ethane recovery is desired, the cooler for distillation column overhead stream 144 is typically not required and can be bypassed, and the lean absorber reflux stream 146 will be introduced into the bottom of absorber 110 as a bottom feed stream as indicated by the dashed lines in FIG. 1.

With respect to suitable feed gas streams, it is contemplated that various feed gas streams are appropriate, and especially suitable feed gas streams may include various hydrocarbons of different molecular weight. With respect to the molecular weight of contemplated hydrocarbons, it is generally preferred that the feed gas stream predominantly includes $C_1$–$C_6$ hydrocarbons. However, suitable feed gas streams may additionally comprise acid gases (e.g., carbon dioxide, hydrogen sulfide) and other gaseous components (e.g., hydrogen). Consequently, particularly preferred feed gas streams are natural gas and natural gas liquids.

In further preferred aspects of the inventive subject matter, the feed gas streams cooled to condense at least a portion of the heavier components in the feed gas stream, and in especially preferred configurations, the feed gas stream is cooled, separated into a vapor portion and a liquid portion, wherein the vapor portion is further cooled and separated into a second vapor portion and second liquid portion. While not limiting to the inventive concept, it is particularly preferred that these cooling steps may be achieved using the refrigerant content of the absorber overhead product and/or the absorber bottom product.

In contemplated configurations, it is further preferred that the separated liquids from the feed gas stream are (combined and) fed into the absorber. With respect to the vapor portions, it should be recognized that the second vapor portion is split into a bypass stream and a turbo-expander stream, wherein the turbo-expander stream is fed into a turbo-expander and subsequently into the absorber, and wherein the bypass stream is (a) further cooled, preferably using the refrigerant content of the absorber overhead product and/or the absorber bottom product, and then (b) let down in pressure via a device other than a turbo-expander before entering the upper section of absorber as a first reflux stream. Especially suitable devices include Joule-Thomson valves, however, all other known configurations and methods to reduce pressure are also considered suitable for use herein. For example, suitable alternative devices might include power recovery turbines and expansion nozzle devices.

The absorber overhead and bottom products are preferably employed as refrigerant in a heat exchanger, wherein the heat exchanger provides cooling for the first and second reflux streams. Furthermore, it is preferred that the absorber overhead product may act as a refrigerant in at least one, and preferably at least two additional heat exchangers, wherein the absorber overhead product cools the separated vapor portion of the feed gas and the feed gas stream before recompression to residue gas pressure. Similarly, the absorber bottom product is employed (preferably in the same heat exchanger) as a refrigerant to cool at least one of the first and second reflux streams before entering the distillation column as column feed. Suitable absorbers may vary depending on the particular configurations, however, it is generally preferred that the absorber is a tray or packed bed type absorber.

The absorber bottom product is separated in a distillation column to form the desired bottom product (e.g., $C_2/C_3$ or, $C_3$ and $C_4^+$). Consequently, depending on the desired bottom product, appropriate distillation columns include a demethanizer and a deethanizer. Where the desired bottom product is $C_3$ and $C_4^+$, it is contemplated that the distillation column overhead product is cooled in a cooler (e.g., using external refrigerant) and separated into a distillation column reflux portion and a vapor portion. Thus, it should be especially appreciated that the vapor overhead product from the distillation column may be employed as first reflux stream for the absorber, wherein the first reflux stream is a lean reflux stream that is fed to the top tray of the absorber Similarly, where the desired bottom product is $C_2/C_3^+$, it is contemplated that the distillation column overhead product bypasses the cooler and, after separation in a separator, the liquid portion is employed as reflux for the distillation column while the vapor portion is employed as a bottom feed to the absorber. Again, it should be especially appreciated that in such configurations of ethane recovery, the vapor overhead product from the distillation column is recycled back to the absorber for re-absorption of the $C_2$ plus components resulting in high ethane recovery.

Thus, it should be especially recognized that in contemplated configurations, the cooling requirements for the absorber are at least partially provided by the reflux streams (via cooling by absorber bottom and overhead products), and that the $C_2/C_3$ recovery significantly improves by employing a first and a second reflux stream. With respect to the $C_2$ recovery, it is contemplated that such configurations provide at least 85%, more typically at least 88%, and most typically at least 90% recovery, while it is contemplated that $C_3$ recovery will be at least 95%, more typically at least 98%, and most typically at least 99%.

In yet another aspect of the inventive subject matter, it should be recognized that contemplated configurations are especially advantageous as an upgrade into an existing natural gas treating plant, wherein the capacity of the upgraded plant significantly increases without rewheeling the expander or replacing the absorber and/or distillation column. Additional equipment for such upgrades will typically include a heat exchanger and piping.

Consequently, a method of increasing throughput in a natural gas recovery plant having an absorber and a distillation column will include a step in which a first reflux stream is provided to the absorber, wherein the first reflux stream comprises an overhead product from the distillation column. In another step, a bypass is provided upstream of a turbo expander, wherein the bypass receives a vapor portion of a cooled natural gas liquid and provides the vapor portion to the absorber. In a still further step, pressure of the vapor portion is reduced before the vapor portion enters the absorber as a second reflux stream, and in yet another step, a heat exchanger is provided that cools at least one of the first and second reflux streams using at least one of an absorber bottom product and an absorber overhead product.

Particularly preferred methods further include a step in which a second vapor portion of the cooled natural gas liquid is expanded in a turbo expander and fed into the absorber, wherein a liquid portion of the cooled natural gas liquid is fed into the absorber. Furthermore, the absorber overhead product may further cool the natural gas liquid and/or a vapor portion of the natural gas liquid, and the reflux stream may be fed into the absorber as a liquid or vapor/liquid feed, wherein the distillation column comprises a deethanizer. Alternatively, the distillation column can also perform as a demethanizer when liquid ethane product is preferred.

Thus, a method of operating a plant may include a step in which an absorber and a distillation column are provided. In another step, a cooled lean overhead product from the distillation column is fed to the absorber as a first reflux stream, and the pressure of a cooled vapor portion of a natural gas feed is reduced via a device other than a turbo expander. In still another step, the cooled vapor portion that is reduced in pressure is fed to the absorber as a second reflux stream. Similarly, contemplated methods may further include a step in a liquid portion of the natural gas feed and a second vapor portion of the natural gas feed are fed into the absorber, wherein the second portion is reduced in pressure via a turbo expander.

Additionally, a heat exchanger may be provided in which at least one of a bottom product and an overhead product of the absorber cool at least one of the first and second reflux streams. Furthermore, it is generally preferred that in such methods at least part of the bottom product is fed from the absorber into the distillation column, and that the device other than the turbo expander comprises a Joule-Thomson valve. Furthermore, where $C_2$ recovery is desired, it is contemplated that the lean reflux stream is provided by the separator vapor and fed into the absorber as a liquid feed and the vapor overhead stream from the distillation column is fed to the bottom of the absorber, wherein the distillation column comprises a demethanizer.

Additionally, in another aspect of the invention subject matter, it should be recognized that contemplated configurations with the absorber operating at a higher pressure than the downstream distillation column prove especially advantageous. Such contemplated configuration would require a compressor that raises the pressure of the vapor stream from the distillation column to a pressure required by the absorber. Such a dual pressure column configuration should be recognized to provide significant overall compression horsepower savings as the compression horsepower required by the residue gas re-compressor is greatly reduced.

Thus, specific embodiments and applications for improved natural gas liquids recovery have been disclosed. It should be apparent, however, to those skilled in the art that many more modifications besides those already described are possible without departing from the inventive concepts herein. The inventive subject matter, therefore, is not to be restricted except in the spirit of the appended contemplated claims. Moreover, in interpreting both the specification and the contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A plant comprising an absorber that receives a first reflux stream and that further receives a second reflux stream, the first reflux stream comprising a cooled lean overhead product from a distillation column, and the second reflux stream comprising a cooled vapor portion of a natural gas feed that is reduced in pressure via a device other than a turbo expander, and wherein the absorber is further configured to receive a liquid portion of the natural gas feed and a second vapor portion of the natural gas feed wherein the second portion is reduced in pressure via a turbo expander.

2. The plant of claim 1 wherein the absorber produces a bottom product that cools at least one of the first and second reflux streams.

3. The plant of claim 2 wherein at least a portion of the bottom product is fed into the distillation column.

4. The plant of claim 1 wherein the absorber produces an overhead product that cools at least one of the first and second reflux streams.

5. The plant of claim 4 wherein the overhead product further cools at least one of the natural gas feed and a vapor portion of the natural gas feed.

6. The plant of claim 1 wherein the device other than the turbo expander comprises a Joule-Thomson valve.

7. The plant of claim 1 wherein the distillation column comprises a demethanizer.

8. The plant of claim 1 wherein the first lean relax stream is fed into the absorber as a vapor/liquid or liquid feed, and wherein the distillation column comprises a deethanizer.

9. A method of operating a plant comprising:

providing an absorber and a distillation column;

feeding a cooled lean overhead product from the distillation column to the absorber as a first reflux stream;

reducing pressure of a cooled vapor portion of a natural gas feed via a device other than a turbo expander;

feeding the cooled vapor portion that is reduced in pressure to the absorber as a second reflux stream in addition to the first reflux stream; and feeding a liquid portion of the natural gas feed and a second vapor portion of the natural gas feed into the absorber, wherein the second portion is reduced in pressure via a turbo expander.

10. The method of claim 9 further comprising providing a heat exchanger in which at least one of a bottom product and an overhead product of the absorber cool at least one of the first and second reflux streams.

11. The method of claim 9 further comprising feeding at least part of the bottom product from the absorber into the distillation column.

12. The method of claim 9 wherein the device other tan the turbo expander comprises a Joule-Thomson valve.

13. The method of claim 9 wherein the first lean reflux stream is fed into the absorber as a vapor/liquid feed, and wherein the distillation column comprises a deethanizer.

14. A method of increasing throughput in a natural gas recovery plant having an absorber and a distillation column, comprising:

providing a first reflux stream to the absorber, wherein the first reflux stream comprises an overhead product from the distillation column;

providing a bypass upstream of a turbo expander, wherein the bypass receives a vapor portion of a cooled natural gas liquid and provides the vapor portion to the absorber, reducing pressure of the vapor portion before the vapor portion enters the absorber as a second reflux stream; and providing a heat exchanger that cools at least one of the first reflux stream and the second reflux stream using at least one of an absorber bottom product and an absorber overhead product.

15. The method of claim 14 wherein a second vapor portion of the cooled natural gas liquid is expanded in a turbo expander and fed into the absorber, and wherein a liquid portion of the cooled natural gas liquid is fed into the absorber.

16. The method of claim 14 wherein the absorber overhead product further cools at least one of the natural gas liquid and a vapor portion of the natural gas liquid.

17. The method of claim 14 wherein the first reflux stream is fed into the absorber as a vapor/liquid or liquid feed and wherein the distillation column comprises a demethanizer.

18. The method of claim 14 wherein the distillation column comprises a demethanizer.

19. The method of claim 18 wherein the absorber is first refluxed by a cooled separator gas, and wherein overhead vapor from the demethanizer is fed to a bottom of the absorber for ethane recovery.

20. The method of any one of claim 9 or 13 wherein the absorber is operated at a pressure higher than a pressure in the distillation column, and wherein a compressor is provided on the distillation column overhead that compresses overhead vapor to the absorber.

21. A plant comprising:

an absorber that is configured to receive a first and a second reflux stream;

a distillation column that is fluidly coupled to the absorber and that is configured to form the first reflux stream from a lean distillation column overhead product;

a pressure reducing device other than a turbo expander that is fluidly coupled to the absorber and that is configured to form the second reflux stream from a cooled separated vapor portion of a natural gas feed.

22. A method of operating a plant comprising:

fluidly coupling an absorber and a distillation column;

feeding a cooled lean overhead product from the distillation column to the absorber as a first reflux stream;

cooling a separated vapor portion of a natural gas feed and reducing pressure of the cooled vapor portion via a device other than a turbo expander to thereby produce a second reflux stream; and feeding the second reflux stream to the absorber in addition to the first reflux stream.

* * * * *

UNITED STATES PATENT AND TRADEMARK OFFICE

CERTIFICATE OF CORRECTION

PATENT NO. : 7,051,553 B2
APPLICATION NO. : 10/469456
DATED : May 30, 2006
INVENTOR(S) : John Mak, Curt Graham and Wayne Chengwen Chung It is certified that error appears in the above-identified patent and that said Letters Patent is hereby corrected as shown below:

On Title page, item 73 Assignee
replace "Floor Corporation"
with --Fluor Corporation--.

On title page, item (75) Inventors
replace "Chengwen Wayne Chung"
with -- Wayne Chengwen Chung --

Signed and Sealed this

Fifteenth Day of August, 2006

JON W. DUDAS
*Director of the United States Patent and Trademark Office*